United States Patent [19]

Okada

[11] 4,020,550

[45] May 3, 1977

[54] CUTTING DEVICE

[75] Inventor: Yoshio Okada, Osaka, Japan

[73] Assignee: Okada Kogyo Kabushiki Kaisha, Osaka, Japan

[22] Filed: May 20, 1976

[21] Appl. No.: 688,301

[30] Foreign Application Priority Data

May 24, 1975 Japan ..... 50-62342
July 14, 1975 Japan ..... 50-86545

[52] U.S. Cl. ..... 30/124; 30/294; 30/292

[51] Int. Cl.[2] ..... B26B 3/08; B26B 25/00

[58] Field of Search ..... 30/124, 130, 286, 292, 30/293, 294, 307

[56] References Cited

UNITED STATES PATENTS

| | | | |
|---|---|---|---|
| 900,300 | 10/1908 | Nicolas | 30/286 |
| 1,574,819 | 3/1926 | Jezler | 30/286 |
| 2,483,092 | 9/1949 | Hanke | 30/124 X |
| 2,889,623 | 6/1959 | Baker | 30/294 |

FOREIGN PATENTS OR APPLICATIONS

| | | | |
|---|---|---|---|
| 1,130,528 | 10/1956 | France | 30/294 |
| 85,256 | 2/1896 | Germany | 30/292 |

*Primary Examiner*—Al Lawrence Smith
*Assistant Examiner*—J. C. Peters
*Attorney, Agent, or Firm*—Wenderoth, Lind & Ponack

[57] ABSTRACT

A cutting device comprises a holder including a pair of spaced plate members connected at one peripheral edge to each other to define an accommodation space therebetween. A cutting disc is, either rotatably or fixedly, mounted on a shaft member and situated within the accommodation space. Rotatably mounted on the shaft member and arranged in the vicinity of and side-by-side relation to the cutting disc is at least one padding disc which acts to retain a material to be cut in position during rotation thereof. Rotation of the padding disc is effected in contact with the material as the cutting device is moved along an intended line of cutting during actual cutting operation.

9 Claims, 11 Drawing Figures

CUTTING DEVICE

BACKGROUND OF THE INVENTION

The present invention generally relates to a cutting device and, more particularly, to a novel and safe cutting device utilizing a replaceable disc blade.

There is known a cutting device, or a knife, which comprises an elongated sheath and a strip of blade slidably housed within the elongated sheath and which has a plurality of equally spaced break-off grooves along which successive portions of the blade strip can be snapped off when they become dull through wear. This type of cutting device, or knife, has achieved commercial success and is now used in a wide range of applications. In addition, this type of cutting device is fairly considered very convenient in view of the fact that a sharp cutting blade can be available at any time merely by breaking a used or worn blade unit off from the blade strip.

However, when it comes to cutting of such a highly flexible material, for example, a sheet of cloth or a film or foil of synthetic resin or resin-metal compound, as is characterized by the fact that, when a cutting edge is applied during cutting operation with or without the use of a ruler which may be used to retain in position the material to be cut, the shape and/or the position of the material being cut tend to be readily destroyed under the influence of a drag force developed by the cutting edge being drawn on the material. Any of currently commercially available cutting instruments, including that type of cutting device which has been referred to above, is of no use in terms of availability for an accurate cut line in the material having been cut.

Moreover, using the above described type of cutting device it is difficult to cut the material to be cut, irrespective of the type thereof, along a curved or substantially zig-zag path, or otherwise. The operator of the cutting device may inadvertently suffer injuries to his finger or fingers.

SUMMARY OF THE INVENTION

As an improved version, though believed to be novel in construction, of the cutting device in terms of substantial elimination of the disadvantages and inconveniences inherent in the conventional instruments, there is provided according to the present invention a cutting device which utilizes a disc blade unit having an outer peripheral edge shaped to provide a continuous blade, and at least one padding disc of an outer diameter substantially equal to or slightly greater than that of the disc blade unit rotatably mounted on a shaft member common to said disc blade unit.

In one aspect of the present invention, the disc blade unit is mounted on the shaft member for adjustable rotation about the longitudinal axis of said shaft member so that consecutive portions of the blade can be utilized one at a time in actual cutting operation.

In another aspect of the present invention, the disc blade unit is rotatably mounted on the shaft member.

In either case, the padding disc may be made of an elastically deformable material, such as natural or synthetic rubber material; in which case an outer peripheral portion of said padding disc is radially inwardly deformed while being concurrently compressed to allow the outer peripheral blade of the disc blade unit to substantially wedge into the material to be cut. At the same time said outer peripheral portion of said padding disc retains the material in position adjacent the outer peripheral blade. The concurrent deformation and compression of the outer peripheral portion of the padding disc takes place when an external pushing and drawing force is applied to the cutting device during an attempt to cut the material to be cut.

Alternatively, the padding disc may be made of a solid material, such as hard plastic material or metallic material, in which case the padding disc must be mounted on the shaft member for displacement in a direction substantially perpendicular to the longitudinal axis of said shaft member, and it is normally biased in one direction counter to the direction of displacement of said padding disc. This takes place when the outer peripheral blade of the disc blade unit is substantially wedged into the material to be cut during the attempt to cut the material.

Irrespective of the material with which the padding disc is constructed, the padding disc is so rotatable about the shaft member in a plane in the vicinity of and parallel to the plane of the disc blade unit that the material being cut can advantageously be retained in position without being deformed or wrinkled as, may otherwise occur under the influence of a drag force developed by the outer peripheral blade of the disc blade unit being drawn on the material. Nevertheless, the cutting device according to the present invention cannot only be used with the flexible material of the type hereinbefore described, but also with a multi-ply paper board, leather or any other sheet material.

BRIEF DESCRIPTION OF THE DRAWINGS

FIGS. 4 and 5 are views similar to FIG. 2, showing second and third preferred embodiment of the present invention, respectively;

DETAILED DESCRIPTION OF THE INVENTION

Figure 1:
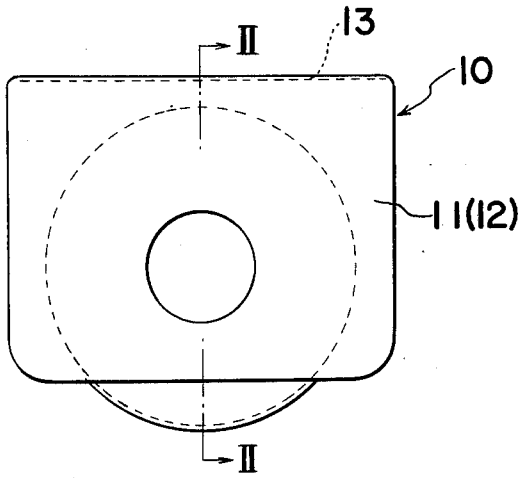
FIG. 1 is a schematic side elevational view of a cutting device according to one embodiment of the present invention.

Before the description of the present invention proceeds, it is to be noted that like parts are designated by like reference numerals throughout the accompanying drawings.

Figure 2:
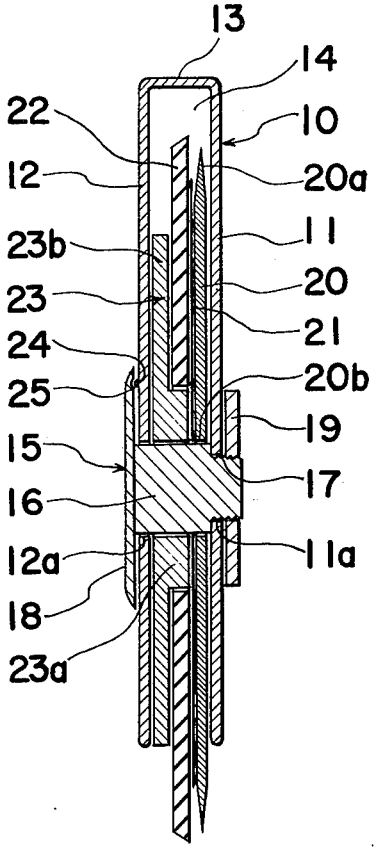
FIG. 2 is a cross sectional view, on an enlarged scale, of the cutting device shown in FIG. 1, which view is taken along the line II—II in FIG. 1.
Figure 3:
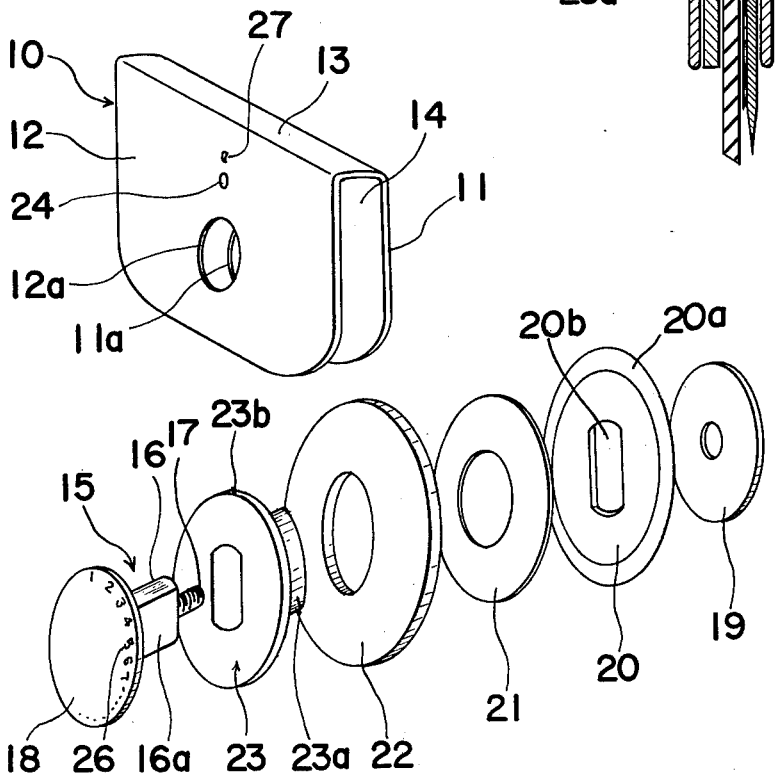
FIG. 3 is an exploded view of the cutting device shown in FIG. 1.

Referring first to FIGS. 1 to 3, a cutting device according to the present invention comprises a holder 10, which may be so formed, either by bending a substantially rectangular metallic plate at two locations or by molding a hard plastic material, as to have a pair of opposed side panels 11 and 12 and a bridging shoulder 13 integrally connecting the side panels 11 and 12 together in spaced relation to each other. Alternatively, these elements 11, 12 and 13 of the holder 10 may be constituted by separate members with which the holder 10 may have been assembled. The side panels 11 and 12 are preferably of the same dimensions and cooperate with the bridging shoulder 13 to define an accommodation space 14.

A mounting body, generally indicated by 15, comprises a shaft member 16 having one end reduced in diameter to provide a threaded portion 17 and the other end integrally formed with a radially outwardly extending flange or disc 18 axially aligned with said shaft member 16. The shaft member 16 has a length so selected as to be substantially equal to the sum of the thickness of either one of the side panels 11 and 12 and the inside span between the side panels 11 and 13. As best shown in FIG. 3, the shaft member 16 has a pair of opposed peripheral surface portions radially inwardly flattened to define respective lateral flanks, only one of which flanks is shown by 16*a* and the function of which flanks 16*a* will become clear from the subsequent description.

For accommodating the mounting body 15 of the construction as hereinbefore described, the side panels 11 and 12 are shown to have a hole 11*a*, substantially equal in diameter to the diameter of the threaded portion 17, and a hole 12*a* substantially equal in diameter to the diameter of the shaft member 16, respectively. As best shown in FIG. 2, the mounting body 15 is held in position in such a manner that the shaft member 16 rotatably extends through the accommodation space 14 while the flange or disc 18 is situated externally of the side panel 12 on one hand and the threaded portion 17 extends outwardly through the hole 11*a* in the side panel 11 and is in turn fastened with a nut member 19 on the other hand.

Figure 5:
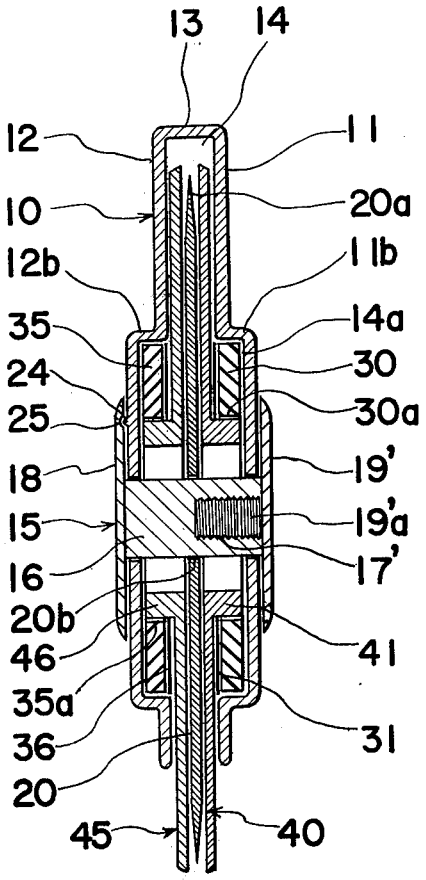

Alternatively, the mounting body 15 may be of a construction as shown in FIG. 5 and which will become clear as to its construction from the description in connection with the embodiment of FIG. 5.

Mounted on a portion of the shaft member 16 between the side panels 11 and 12 and within the accommodation space 14 of the holder 10 are a cutting disc 20, a friction reducing disc 21, a padding disc 22 and a back-up wheel 23 arranged in the order given above from the side panel 11 towards the side panel 12.

The cutting disc 20 is made of any metallic material, for example, stainless steel, suited for the production of blades or razors and is of a type having an outer peripheral edge shaped to provide a peripheral blade 20*a*. Although the peripheral blade 20*a* in the instance as shown is shown to have been defined by double-bevelling the outer peripheral edge of the cutting disc 20, it may be defined by single-bevelling the same. This cutting disc 20 has a central bore 20*b* shown to be so complimental in shape to the cross sectional shape of the shaft member 16, as best shown in FIG. 3, that it can rotate together with the shaft member 16 and, therefore, the mounting body 15.

The back-up wheel 23 rotatable about the shaft member 16 independently of the latter includes a sleeve 23*a* having a bore of a diameter substantially equal to the diameter of the shaft member 16 and an annular back-up flange 23*b* radially outwardly extending from one end of said sleeve 23*a*. This back-up wheel 23 is rotatably carried by the mounting body 15 within the accommodation space 14 in such a manner that, while the sleeve 23*a* is mounted on the shaft member 16, the other end of said sleeve 23*a* opposed to the flange 23*b* faces the cutting disc 20. The back-up flange 23*b* has a radius, as measured from the center of rotation thereof to the outer periphery thereof, smaller than that of the cutting disc 20 and preferably equal to or slightly smaller than the distance from the center of the hole 11*a* or 12*a* to one edge of the side panel 11 or 12 opposed to the bridging shoulder 13 so that the back-up wheel 23 can completely be accommodated within the accommodation space 14.

The back-up wheel 23 may be made of either a hard plastic material or a metallic material. However, where the back-up wheel 23 is to be made of plastic material, in consideration of the purpose, as will be described later, for which the back-up flange 23*b* serves, the type of plastic material need be selected so as to allow the back-up flange 23*b* to have a sufficient physical strength without inviting any unreasonable increase of the thickness of the back-up flange 23*b* which may be preferred within the range of 1 to 3 millimeters.

The padding disc 22, which is made of synthetic or natural rubber material and which may preferably be at least 3 millimeters in thickness, is rotatably mounted on the sleeve 23*a* and is held in position between the back-up flange 23and the cutting disc 20. This padding disc 22 is rotatable about the shaft member 16 together with the back-up wheel 23 when the outer peripheral face of said padding disc 22 is held in contact with a material to be cut while the cutting device is drawn on the material to be cut along an intended line of cutting.

For facilitating the rotation of the padding disc 22 relative to the cutting disc 20 fixedly mounted on the shaft member 16, the friction reducing disc 21 is mounted on the shaft member 16 between the cutting disc 20 and the padding disc 22. Although in the instance as shown the friction reducing disc 21 is shown to be mounted on the shaft member 17, it may be mounted on the sleeve 23*a* of the back-up wheel 23. In addition, depending upon the frictional coefficient the material for the friction reducing disc 21 may have in relation to one or both of the cutting disc 20 and the padding disc 22, the friction reducing disc 21 may be mounted either fixedly or rotatably on the shaft member 16 or the sleeve 23*a*.

The friction reducing disc 21 is made of a material having a relatively low frictional coefficient and may be prepared from a film of tetraflouroethylene or polyacetal resin. Alternatively, if the thickness of the friction reducing disc 21 may not prove inconvenient, it may be prepared from a thin metallic disc.

While the cutting device according to the present invention is constructed in the manner as hereinbefore described, it will readily be seen that, during a cutting operation in which a drawing force is applied to the holder 10 to move the cutting device on the material to be cut along the intended line of cutting while the holder 10 is concurrently downwardly pressed by the application of a slight pressing force to the holder, a portion of the peripheral blade 20*a* of the cutting disc 20 separates the material being cut into two fractions. At this time, the outer peripheral face of the padding disc 22 is radially inwardly compressed and/or deformed to allow that portion of the peripheral blade 20*a* to outwardly project through the padding disc 22 and substantially wedge into the material being cut and also to retain the material being cut in position at one of the opposed sides of the peripheral blade 20*a*. The back-up flange 23*b* serves at this time to avoid any arbitrary fluctuation of an annular portion of the padding disc 22 adjacent the shaft member 17, which arbitrary fluctuation may otherwise result in biting of the outer peripheral edge of the padding disc 22 between the peripheral blade 20*a* and the material being cut.

After that particular portion of the peripheral blade 20*a* of the cutting disc 20 has become dull through wear, the cutting disc 20 may angularly be displaced a predetermined distance to allow another fresh portion of the peripheral blade 20*a* adjacent the previously used portion thereof to be ready for use in cutting. For this purpose, a detent mechanism is utilized in the cutting device of FIG. 1, which detent mechanism comprises at least one projection 24 formed in the side panel 12 and outwardly projecting therefrom and a plurality of equally spaced detent recesses 25 defined in one of the opposed faces of the flange or disc 18 which is adjacent the side panel 12, it being understood that the detent recesses 25 are arranged in a substantially circular configuration co-axial with the longitudinal axis of the shaft member 16.

To stepwisely rotate the cutting disc 20 each time each of the consecutive portions, corresponding in number to the number of the detent recesses 25 on the flange or disc 18, of the peripheral blade 20*a* has been used and therefore worn out, a temporary unfastening or loosening of the nut member 19 is necessary. In other words, by loosening and then fastening the nut member 19, the cutting disc 20 can stepwisely be rotated through 360° together with the shaft member 16. In order to avoid the possibility that the same portion of the peripheral blade 20*a* as has previously been used may be used again in actual cutting, the other face of the flange or disc 18 remote from the side panel 12 may have a plurality of equally spaced indicium, generally indicated by 26 and equal in number to the number of detent positions defined by the detent mechanism, which indicium are cooperative with an index marking 27. The indicium 26 and the index marking 27 may be either imprinted or embossed on the flange or disc 18 and the side panel 12, respectively, it being noted that the indicium 26 are shown as constituted by serial numbers starting from 1.

In the construction so far described, the nut member 19 may be a wing nut, a knurled nut or a cap nut. However, for facilitating the nut member 19 to be readily fastened to the threaded portion 17, the nut member 19 is preferably of a size sufficient to allow it to be fastened merely by turning the palms of the hands of the user in the opposed directions while the cutting device is held therebetween. In addition, if desired, another friction reducing disc similar in construction to the friction reducing disc 21 may be employed and positioned between the cutting disc 20 and the side panel 11. Moreover, the back-up wheel 23 may not be always necessary if the inside span between the side panels 11 and 12 is substantially equal to or slightly greater than the sum of thicknesses of the elements 20, 21 and 22.

In the embodiment shown in FIGS. 1 to 3, since only one padding disc 22 is employed, one of the opposed portions of the material to be cut, each on one side of the intended line of cutting on the material, which is not in contact with the outer peripheral face of the padding disc 22 during the cutting operation, may become wavy or wrinkled unless a ruler or the like is employed to retain that portion of the material being cut. In addition, by the same reason, one side of the peripheral blade 20*a* is so exposed that a single touch of the peripheral blade 20*a* may result in injuries.

Figure 4:
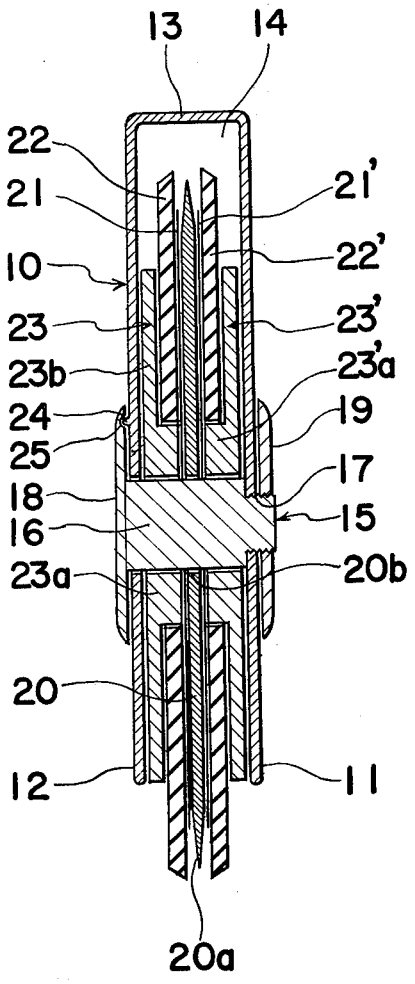
FIG. 4 is a view similar to FIG. 2, showing a second preferred embodiment of the present invention.

In order to avoid thse inconveniences inherent in the cutting device according to the embodiment of FIGS. 1 to 3, a set of frictional reducing disc, padding disc and back-up wheel, all identical in construction and shape to the friction reducing disc 21, padding disc 22 and back-up wheel 23, respectively, may be additionally employed as shown by 21′, 22′ and 23′ in FIG. 4.

Figure 6:
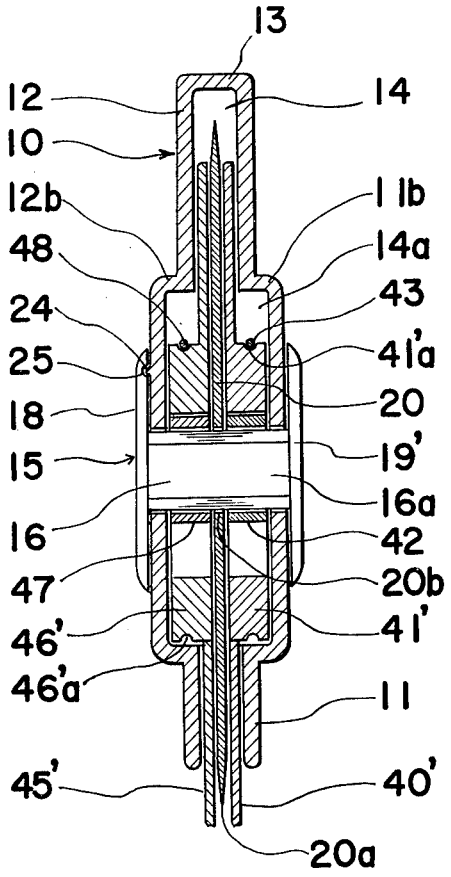
FIG. 6 is a view similar to FIG. 2, but taken along the line VI—VI in FIG. 7, showing a cutting device according to a fourth preferred embodiment of the present invention.

With reference to FIG. 4, it is readily understood that the peripheral blade 20*a* is, when the cutting device is not in use, completely accommodated within a space defined between the padding discs 22 and 22′ and, therefore, the accessibility to the peripheral blade 20*a* is reduced as compared with that afforded by the cutting device of FIGS. 1 to 3. Moreover, during the cutting operation, the peripheral faces of the respective padding discs 22 and 22′ retain the respective portions of the material being cut at the opposed sides of the peripheral blade 20*a* while they rotate about the shaft member 16.

Where the padding discs are desired to be made of hard plastic material or metallic material, the cutting device may be constructed in a manner as shown in FIG. 5 or FIG. 6, which will now be described.

Referring to FIG. 5, the side panels 11 and 12 are outwardly recessed at respective portions around the bearing holes 11*a* and 12*a* to define a substantially enlarged accommodation chamber 14*a* in communication with the accommodation space 14. Therefore, the side panels 11 and 12 have respective annular walls 11*b* and 12*b* each extending parallel to the longitudinal axis of the shaft member 16.

The mounting body 15 used in the embodiment of FIG. 5 differs from that used in the foregoing embodiment and, in particular, the shaft member 16 has a threaded hole 17′ into which a threaded projection 19′ a integral with a disc 19′ is engaged. In addition, the length of the shaft member 16 in the embodiment of FIG. 5 is substantially equal to or slightly greater than the sum of the inside span between that axially outwardly recessed portions of the side panels 11 and 12 and the thickness of the side panels 11 and 12.

Annular cushions 30 and 35 of the same size, each having an outer diameter substantially equal to the inner diameter of the axially outward recessed portion of the side panel 11 or 12, have a inner bore 30*a* and 35*a* greater than the diameter of the shaft member 16 and are held in position within the respective recessed portions of the side panels 11 and 12. Padding discs 40 and 45 each on one side of the cutting disc 20 are shown to have axially extending sleeves 41 and 46 each having an outer diameter substantially equal to the inner diameter of the annular cushion 30 or 35 and an inner diameter greater than the diameter of the shaft member 16. Therefore, it is clear that the padding discs 40 and 45 are rotatably held in position within the accommodation space 14, while said sleeves 41 and 45 are rotatably accommodated within the bores of the annular cushions 30 and 35, respectively.

The annular cushions 30 and 35 are made of such an elastic material as to allow the padding discs 40 and 45 to be simultaneously or independently displaced in a direction perpendicular to the longitudinal axis of the shaft member 16 and substantially counter to the direction in which the pushing force is applied during the cutting operation with that portion of the peripheral blade 20*a* being substantially wedged into the material being cut. At this time, the individual portions of the annular cushions 30 and 35 substantially opposed to and remote from that portion of the peripheral blade 20*a* engaged to the material being cut are radially outwardly compressed in contact with the sleeves 41 and 46 coaxially integral with the respective padding discs 40 and 45.

It is to be noted that, in the embodiment shown in FIG. 5, annular friction reducing members 31 and 36, made of material having a low frictional coefficient in a similar manner as the friction reducing discs 22 and 22' in the foregoing embodiment, are mounted on the sleeves 41 and 46 and held in position between the padding disc 40 and the annular cushion 30 and between the padding disc 45 and the annular cushion 35, respectively.

It is further to be noted that the difference between the inner diameter of each of the sleeves 41 and 46 and the diameter of the shaft member 16 is so selected that that portion of the peripheral blade 20*a* of the cutting disc 20 can be sufficiently exposed out of the space between the padding discs 40 and 45 when the latter are laterally displaced in contact with the material being cut in the manner as hereinbefore described.

Even in the embodiment of FIG. 5, a group of such elements as indicated by 30, 31 and 40 or 35, 36 and 45 and their associated parts may be omitted, in a substantially similar manner as shown in FIGS. 1 to 3.

Figure 7:
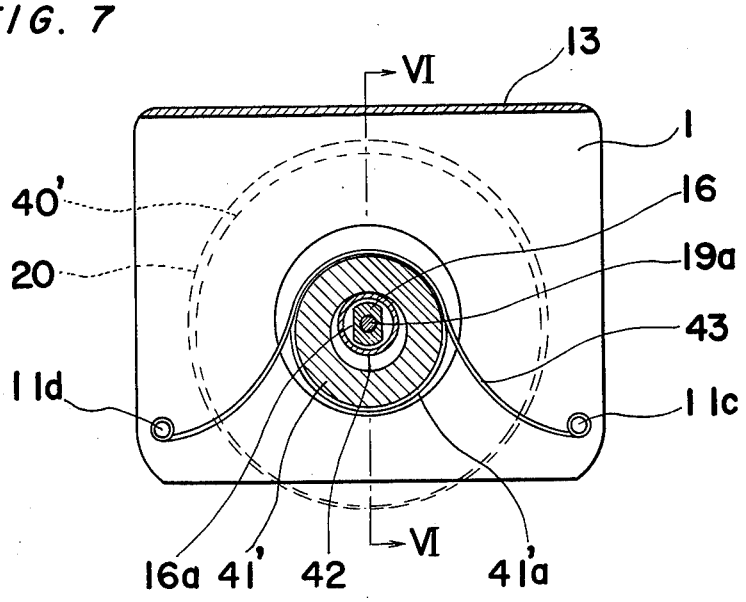
FIG. 7 is a side sectional view of the cutting device shown in FIG. 6.

In the embodiment shown in FIGS. 6 and 7, each of padding discs 40' and 45' is shown to have an annular block 41' or 46' having an inner bore of a diameter greater than the diameter of the shaft member 16 and further having a groove 41'*a* defined in the outer peripheral surface of the annular block 41' or 46 and circumferentially extending therearound. These padding discs 40' and 45' of the construction as hereinbefore described are accommodated within the accommodation space 14 with the annular blocks 41' and 45' loosely mounted on the shaft member 16 at respective sides of the cutting disc 20 through associated spacer sleeves 42 and 47, which sleeves 42 and 47 may either be fixedly or rotatably mounted on said shaft member 16 and have an inner diameter substantially equal to or slightly greater than the diameter of the shaft member 16.

These padding discs 40' and 45' in the embodimemt of FIGS. 6 and 7 are downwardly biased in a direction opposed to the direction toward the bridging shoulder 13 of the holder 10 by wire springs 43 and 48. As best shown in FIG. 7, the wire spring 43 has both ends secured at 11*c* and 11*d* to the panel 11 while a substantially intermediate portion thereof is slidingly engaged in a portion of the groove 41'*a* on the block 41' so that a biasing force exerted by said wire spring 43 can be transmitted to said block 41' so as to displace the latter perpendicularly to the axis of the shaft member 16 in a direction counter to the direction towards the shoulder 13. The wire spring 48 on the other hand is supported in position and acts on the block 46' in the same manner as the wire spring 43 is supported and acts on the block 41' and, therefore, the details thereof are herein omitted for the sake of brevity.

In the construction as shown in FIGS. 6 and 7, it is clear that, when that portion of the peripheral blade 20*a* which is situated, in a similar manner as hereinbefore described in connection with any of the foregoing embodiments, outside the holder 10 together with respective portions of the outer peripheries of the padding discs 40' and 45' is applied to the material to be cut, the padding discs 40' and 45' are laterallly shifted against the respective wire springs 43 and 48 in contact with the material to be cut during the continued application of the external pushing force to the holder 10 of the cutting device, thereby allowing that portion of the peripheral blade 20*a* to be substantially wedged into the material in readiness of the actual cutting operation. The actual cutting operation is initiated when the holder 10 and, therefore, the cutting device as a whole, is drawn in a direction along the intended line of cutting on the material to be cut. During the actual cutting operation so performed, the consecutive portions at the outer periphery of each of the padding discs 40' and 45' serve to retain in position the material being cut during rotation thereof which is effected as the cutting device is pulled along the intended line of cutting on the material.

Figure 8:
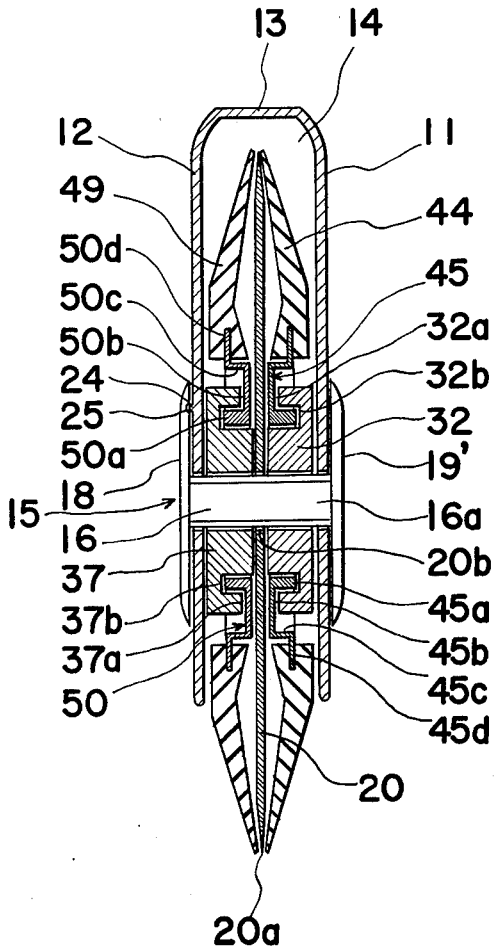
FIG. 8 is a view similar to FIG. 2, showing a fifth preferred embodiment of the present invention; padding disc for facilitating deformation thereof, respectively.

Referring now to FIG. 8, mounted either fixedly or rotatably on the shaft member 16 and operatively housed within the accommodation space 14 are cylindrical support blocks 32 and 37 of the same construction situated on respective sides of the cutting disc 20. Each of these support blocks 32 and 37 has an annular cutout portion 32*a* or 37*a*, defined at one outer peripheral edge thereof adjacent the cutting disc 20, and an annular groove 32*b* or 37*b* coaxial with the longitudinal axis of the shaft member 16 and held in communication with the cutout portion 32*a* or 37*a*.

The padding discs 44 and 49 are shown to be in the form of annular discs and may be made of either a hard plastic material or a metallic material. These padding discs 44 and 49 are respectively supported on and in spaced relation to the support blocks 32 and 37 by means of associated annular carriers 45 and 50 each being of a construction which will now be described.

Each of the annular carrier 45 and 50 has an axial protuberance 45*a* or 50*a*, an annular wall 45*b* or 50*b* having an inner peripheral edge integral with said axial protuberance 45*a* or 50*a*, a cylindrical flange 45*c* or 50*c* having one end integral with the outer peripheral edge of the annular 45*b* or 50*b* and axially extending in a direction opposed to the cutting disc 20 and in the same direction as the direction of extension of the axial protuberance 45*a* or 50*a*, and an annular wall 45*d* or 50*d* having an inner peripheral edge integral with the other end of the cylindrical flange 45*c* or 50*c*.

While the annular carriers 45 and 50 are supported on the respective cylindrical support blocks 32 and 37 with the axial protuberances 45*a* and 50*a* rotatably accommodated within the annular grooves 32*b* and 37*b*, the annular padding discs 44 and 49 are respectively mounted on the annular carriers 45 and 50 in equally spaced relation to the associated outer peripheral surfaces of the cylindrical support blocks 32 and 37 said annular walls 45*d* and 50*d* are rigidly wedged into said annular padding discs 44 and 49 as shown, the annular walls 45*b* and 50*b* radially outwardly extending from the protuberances 45*a* and 50*a* towards the associated padding discs 44 and 49.

It is to be noted that, when the padding discs 44 and 49 are desired to be made of a hard plastic material or a metallic material, the carriers 45 and 50 except for the axial protuberances 45*a* and 50*a*, are to be made so as to have a relatively small thickness sufficient to allow the padding discs 44 and 49 to be laterally displaceable against the elasticity they may have. More specifically, the carriers 45 and 50 are preferred to be made of spring steel, such as a high carbon containing stainless steel, having a relatively high spring characteristic. Even though the carriers 45 and 50 are made of spring steel, the padding discs 44 and 49 may be made of elastic synthetic or natural material.

It is further to be noted that the annular walls 45*b* and 50*b* together with the cylindrical flanges 45*c* and 50*c* and the annular walls 45*d* and 50*d* are each made of equally spaced, separate segments.

With the construction shown in FIG. 8, it is clear that, as the cutting device is pulled along the intended line of cutting on the material to be cut with the peripheral blade 20*a* of the cutting disc 20 engaged in the material during the actual cutting operation, the padding discs 44 and 49 rotate about the longitudinal axis of the shaft member 16 together with the associated carriers 45 and 50 in contact with the material being cut.

In any of the foregoing embodiments shown in FIGS. 1 to 3, FIG. 4, FIG. 5, FIGS. 6 and 7 and FIG. 8, the outer peripheral edge of the padding disc is preferably beveled, as shown, towards the cutting disc 20. Alternatively, it may be shaped such that the thickness thereof gradually decreases towards the outer periphery of said padding disc.

Furthermore, although the shaft member 16 has been described as having a pair of opposed flanks 16*a* for the purpose of enabling the cutting disc 20 to be fixedly mounted on the shaft member 16, but rotatable together with said shaft member 16, the cross section of the shaft member 16 may have any other polygonal shape, such as square, triangle, hexagonal or cruciform, than the illutrated shape.

In describing the various, foregoing embodiments of the present invention with reference to the associated figures of the accompanying drawings, the cutting disc 20 has been described as fixedly mounted on the shaft member and stepwisely rotatable together with the shaft member 16 as regulated by the detent mechanism. However, it is possible to make the cutting disc 20 rotatable independently of the shaft member 16, merely by utilizing the shaft member 16 of circular cross section with the circular hole in the cutting disc 20. Alternatively, the same object can be achieved merely by modifying or changing each of the embodiments, except for those of FIGS. 1 to 3 and FIG. 5, in the following manner.

In the embodiment of FIG. 4 either one of the sleeves 23*a* and 23*a* ' may be made to have a greater length than that of the other of the sleeves 23*a* ' *and 23a* and, then, the cutting disc 20 is rotatably mounted on the longer sleeve 23*a* or 23*a*. '

In the embodiment of FIGS. 6 and 7, where the cross section of the shaft member 16 is made to be circular and the shape of the hole in the cutting disc 20 is accordingly made to be circular as hereibefore described, such elements as indicated by 42 and 47 may be omitted or may be made into an integral part. In the latter case, the cutting disc 20 may be mounted on shaft member 16 through said integral part constituted by the elements 42 and 43.

In the embodiment of FIG. 8, the cutting disc 20 may be mounted on either one of the blocks 32 and 37 if said one of the blocks 32 and 37 has a greater length than that of the other.

In any event, where the cutting disc is made to rotate about the shaft member as hereinbefore described, no detent mechanism, which has been described as comprised of the detent projection 24 and the detent recesses 25, is necessary.

Figure 9A:
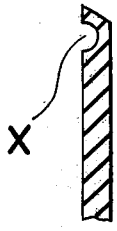
FIGS. 9(*a*) and 9(*b*) are cross sectional views of the outer periphery of padding discs.
Figure 9B:
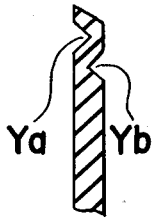

With reference to FIGS. 9(*a*) and 9(*b*), each of the padding discs if made of elastic material may have a portion adjacent the outer periphery thereof shaped as shown. In particular, in FIG. 9(*a*), an annular groove X is formed in that portion of the padding disc at one of the surfaces thereof adjacent the outer periphery thereof so that the outer peripheral portion of the padding disc can readily be deformed in contact with the material to be cut to allow the peripheral blade 20*a* to be substantially wedged into the material during the cutting operation. Although the groove X is shown to have a substantially semi-circular cross section, it may have a V-shaped cross section as shown by y*a* in FIG. 9(*b* ).

The number of the groove may not be limited to one, but if a plurality of grooves are employed, they are preferred to be defined on the both surfaces of the padding disc in an alternate relation as shown by Y*a* and Y*b* in FIG. 9(*b*).

Figure 10:
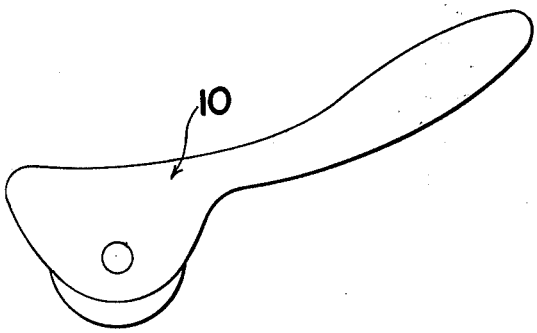
FIG. 10 is a schematic diagram showing, on a reduced scale, an outer appearance of a modified holder of the cutting device according to the present invention.

Furthermore, with the holder 10 of the construction as shown, the bridging shoulder 13 and respective portions of the side panels 11 annd 12 adjacent said bridging shoulder 13 serve as a grip accessible to the hand of the operator of the cutting device according to the present invention. The grip so defined would be inconventient to hold if the cutting device according to the present invention is made compact in size. In such case, the holdeer may have a hand grip outwardly extending from the holder as shown in FIG. 10, which hand grip is accessible to the hand of the operator and is shaped comfortable to hold the cutting device.

Although the present invention has fully been described by way of the preferred embodiments thereof, it is to be noted that various changes and modifications are apparent to those skilled in the art. Accordingly, unless such changes and modifications depart from the true scope of the present invention, they should be construed as included therein.

What I claim is:

1. A cutting device which comprises:

a holder including a pair of spaced plate members connected at one peripheral edge to each other to define an accommodation space therebetween;

a cutting disc having an outer periphery defined into a peripheral blade, said cutting disc being operatively accommodated within said accommodation space;

means for supporting said cutting disc in position within said accommodation space with a portion of said peripheral blade situated outside said accommodation space for use in actual cutting of a material to be ultimately cut into two separate fractions;

padding disc means; and means for supporting said padding disc means within said accommodation space and in side-by-side relation to said cutting disc for rotation thereabout, said padding disc means acting, during cutting operation with the cutting device moved along an intended line of cutting on said material, to retain said material in position while being rotated in contact with said material.

2. A cutting device as claimed in claim 1, wherein said padding disc means comprises a padding disc made of elastic material and having an outer diameter substantially equal to or greater than the outer diameter of said peripheral blade, and said means for supporting said cutting disc comprises a shaft member exending between said plate members across said accommodation space, a portion adjacent the outer periphery of said padding disc being radially inwardly compressed against the elasticity of said padding disc when in contact with said material during the actual cutting operation.

3. A cutting device as claimed in claim 2, further comprising means operatively interposed between said cutting disc and said padding disc for reducing a friction which may otherwise occur between said cutting disc and said padding disc during the rotation of the latter in contact with the material being cut.

4. A cutting device as claimed in claim 2, wherein said cutting disc is fixedly mounted on said shaft member, and further comprising a detent mechanism for providing a plurality of detent positions for cutting disc so that, depending upon positioning of said cutting disc to any one of said detent positions, consecutive portions, substantially equal in number to the number of said detent positions, of the peripheral blade can be used in actual cutting of the material.

5. A cutting device as claimed in claim 3, wherein said cutting disc is fixedly mounted on said shaft member, and further comprising a detent mechanism for providing a plurality of detent positions for the cutting disc so that, depending upon positioning of said cutting disc to any one of said detent positions, consecutive portions, substantially equal in number to the number of said detent positions, of the peripherall blade can be used in actual cutting of the material.

6. A cutting device as claimed in claim 1, wherein said padding disc means comprises a pair of padding discs of the same construction one on each side of said cutting disc and having an outer diameter substantially equal to or greater than the outer diameter of said cutting disc, and means for supporting said cutting disc comprises a shaft member extending between said plate member across said accommodation space, each of said padding discs being made of elastic material and a portion adjacent the outer periphery of said padding disc being radially inwardly comressed against the elasticity of said padding disc when in contact with said material during the actual cutting operation.

7. A cutting device as claimed in claim 6, further comprising means operatively between one of said padding discs and said cutting disc and also between the other of said padding discs and said cutting disc for reducing respective frictions which may otherwise occur between said cutting disc and said one of said padding discs and between said cutting disc and said other of said padding discs during the rotation of said cutting discs in contact with said material being cut.

8. A cutting device as claimed in claim 6, wherein said cutting disc is fixedly mounted on said shaft member, and further comprising a detent mechanism for providing a plurality of detent positions for the cutting disc so that, depending upon positioning of said cutting disc to any one of said detent positions, consecutive portions, substantially equal in number to the number of said detent positions, of the peripheral blade can be used in actual cutting of the material.

9. A cutting device as claimed in claim 7, wherein said cutting disc is fixedly mounted on said shaft member, and further comprising a detent mechanism for providing a plurality of detent positions for the cutting disc so that, depending upon positioning of said cutting disc to any one of said detent positions, consecutive portions, substantially equal in number of said detent positions, of the peripheral blade can be used in actual cutting of the material.

* * * * *